United States Patent [19]

Fitzgerald

[11] 4,189,878

[45] Feb. 26, 1980

[54] HOUSE ROOF INSULATION VENT

[76] Inventor: Gerald A. Fitzgerald, 4937 Drew Ave. S., Minneapolis, Minn. 55410

[21] Appl. No.: 787,897

[22] Filed: Apr. 15, 1977

[51] Int. Cl.[2] ..... E04B 1/74; F24F 7/00

[52] U.S. Cl. ..... 52/95; 52/94; 52/105; 52/198; 98/37; 98/42 R; 98/DIG. 6

[58] Field of Search ..... 52/94, 95, 96, 105, 52/631, 198, 199; 98/37, 42 R, DIG. 6, 42.1

[56] References Cited

U.S. PATENT DOCUMENTS

| | | | |
|---|---|---|---|
| 2,969,726 | 1/1961 | Bottom | 98/37 |
| 3,160,987 | 12/1964 | Pinkley | 52/105 X |
| 3,240,144 | 3/1966 | Lind | 98/42 X |
| 3,683,785 | 8/1972 | Grange | 52/95 X |
| 3,863,553 | 2/1975 | Kootnz | 52/95 X |
| 3,883,999 | 5/1975 | Nicoll, Jr. | 52/105 X |
| 3,972,164 | 8/1976 | Grange | 52/95 |

*Primary Examiner*—Leslie Braun
*Attorney, Agent, or Firm*—Kinney, Lange, Braddock, Westman & Fairbairn

[57] ABSTRACT

In a house structure in which insulating material is to be laid in between and over the attic floor joists, an insulation vent is provided in spaced relation to the roofing boards to allow for free flow of ventilating air between the soffit and the interior of the attic above the insulating material and along the roof boards. This insulation vent is sold flat. To be installed it is folded on pre-scored crease lines, first to form an elongated trough consisting of a rectangular roof clearing sheet and two upwardly extending roof contacting spacer flanges. A lower end portion of the roof clearing sheet is folded down to become a wall sheathing contact sheet, and the flanges which fold down with it are stapled to the roof rafters to hold the roof clearing sheet and sheathing contact sheet in place. The upper end of the roof clearing sheet is folded down also on a pre-scored crease line to form a stiffener tab for the upper end portion of the roof clearing sheet and the two flanges folding down with it are stapled into the roof rafters to permanently position the stiffener tab under the upper end of the roof clearing sheet and to hold the upper end of the roof clearing sheet in position with the roof clearing sheet spacer flanges held against the roof boards.

4 Claims, 4 Drawing Figures

HOUSE ROOF INSULATION VENT

BACKGROUND OF THE INVENTION

In order to limit heat transfer through houses, it has become necessary and desirable to provide insulating material between attic floor joists and to considerable distances above the attic floor joists of such houses. Should this insulating material become sealed against the underside of the roofing boards between the roof rafters, however, it will cut off or severely restrict the necessary free flow of ventilating air to and from the areas in the attic above the insulating materials. Such restriction permits moisture buildup in and under the insulating material causing loss of insulation qualities and other damage, due, for example, to condensation within the walls of the house. Therefore, it is presently required to provide a free air passageway between each pair of adjacent roof rafters and adjacent the roof boards. Typically this passageway should extend from rafter to rafter and should be at least one inch deep.

This invention deals with a simple house roof insulation vent which can easily be installed to insure that this ventilating passageway is established and will be maintained during the entire life of the house while, at the same time, allowing insulating materials to be initially distributed to the maximum possible allowable depth adjacent the outer edges of the attic floor joists and on top of the outer wall plates.

An additional problem, before the present invention, was the blow by or overflow of particulate insulating material over the outer wall stud contacting wall plates at the ends of the joist runs when such insulation is being installed by blowing or by pouring. This problem as well as the problem of insuring that air space for the required ventilation flow is provided was addressed in the patent to Lind, U.S. Pat. No. 3,240,144, granted in March of 1966. In this structure, however, a simple vertical baffle plate 9 was fastened to one of the faces of the wall plate so that insulation would be blocked by the baffle plate and would not run over it along the top of the outer wall and into the soffit where it would tend to block air vents and to destroy the passageway for air to and from the soffit and the upper part of the attic. A similar structure is indicated in the patent to Bottom, U.S. Pat. No. 2,969,726, granted in January of 1961. Neither of these structures, however, provided a positive barrier to prevent reduction of the cross sectional area of the ventilating air passageway to less than a predetermined desirable minimum.

Various other plans for forming troughs of roof clearing sheets and flanges have been devised previous to the present invention, and some of them have even provided downwardly extending sheets designed to come into contact, or at least to closely approach, the upper outer vertical wall stud contacting wall plates. These structures have been deficient in that they did not provide for a positive positioning or fastening of an outer wall sheathing contact sheet, did not provide a vertical stiffener tab at the upper end of a roof clearing sheet, and did not provide for the permanent positioning or fastening of this upper end stiffener tab.

No search was made of the structure of the invention; but applicant knows of no structure which anticipates the claims presented in the specification.

BRIEF SUMMARY OF THE INVENTION

An insulation vent for installation in new or existing housing between adjacent roof rafters includes a rectangular roof clearing sheet, two upwardly extending roof contacting, roof clearing sheet spacer flanges integral with that sheet and extending upwardly therefrom to be in contact with roof boards of a house to be insulated, and an outer wall sheathing contact sheet integral with a lower end of the roof clearing sheet, the sheathing contact sheet having integral sheathing contact sheet positioning flanges extending outwardly therefrom in position to be permanently fastened to the roof rafters by nailing or stapling or the like. The vent also includes a roof clearing sheet stiffener tab integral with an upper end of the roof clearing sheet, and stiffener tab positioning flanges extending outwardly from ends of the stiffener tab in position to be permanently fastened to the roof rafters to hold the stiffener tab in substantially normal relationship to the roof clearing sheet.

IN THE DRAWINGS

DESCRIPTION OF PREFERRED EMBODIMENTS

Figure 1:
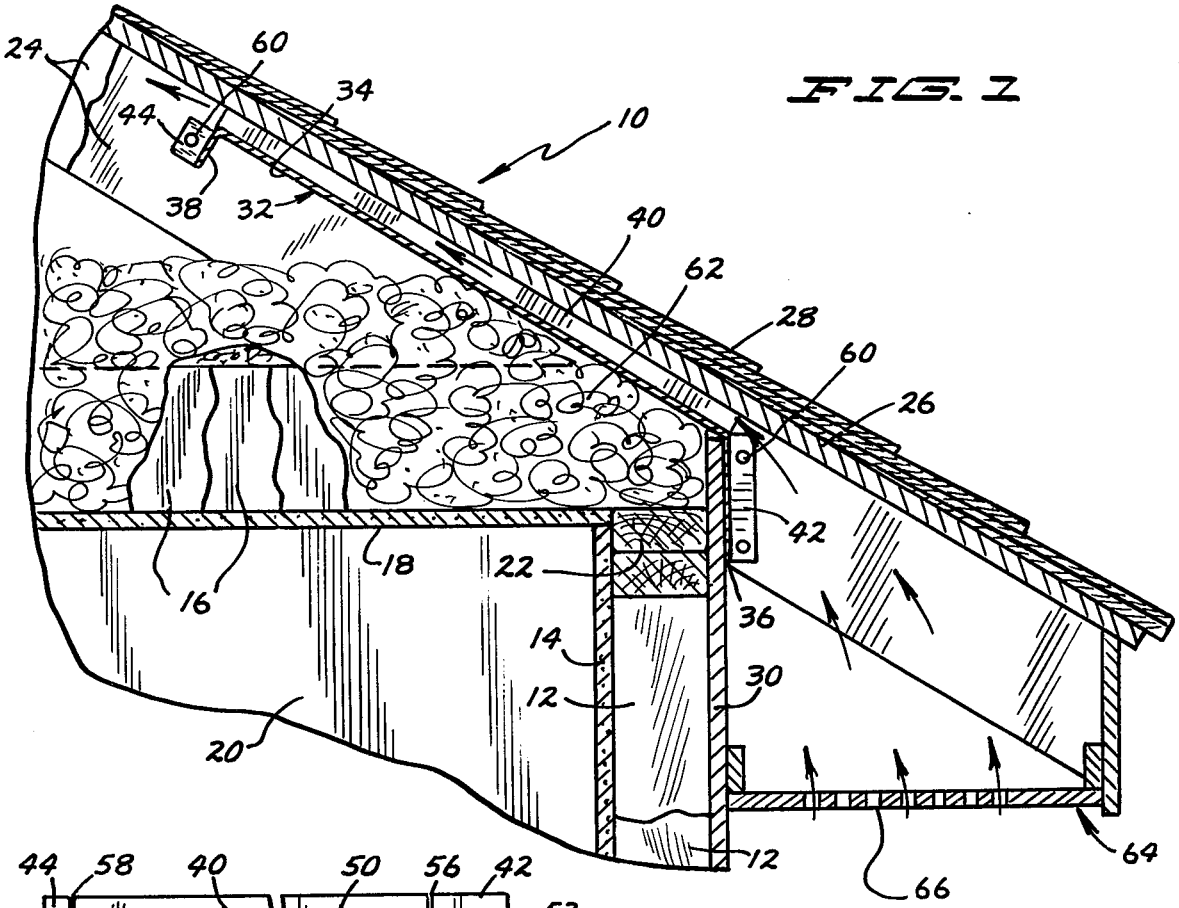
FIG. 1 is a fragmentary vertical sectional view of a portion of a house construction showing the relationship of a house roof insulation vent of the present invention installed in a first manner appropriate during the initial construction of the house, for example.

The illustrated corner of a housing structure 10 discloses vertical outer wall studs 12,12, interior wall board 14, attic floor joists 16,16 and a ceiling wall board or layer 18 partially defining a heated room or space 20. An upper, outer wall stud contacting wall plate 22 consisting of two spiked together two by fours forms the top edge of the vertical outer wall, and spaced apart roof rafters 24,24 are notched out to fit along and to be carried by this wall plate 22. Roof boards 26 are nailed on top of the roof rafters 24, and roofing material such as, for example, shingles 28, are fastened on top of that. An outer wall sheathing 30 is fastened to the outside of the vertical studs 12,12, and can extend partially up inside of the space between rafters 24,24 as shown, but this is not essential.

An object of the invention is to provide insulation vent which will allow insulating material to be installed between and over the attic floor joists to an acceptable level by present standards while maintaining a substantial passageway for the free flow of ventilating air along the interior face of the roof boards. To do this, a house roof insulation vent 32 includes a rectangular roof clearing sheet 34, an outer wall sheathing contact sheet 36, a roof clearing sheet upper end stiffener tab 38, a pair of roof clearing sheet spacer flanges 40,40 each integral with the roof clearing sheet 34 along a separate longitudinal edge thereof, a pair of sheathing contact sheet positioning flanges 42,42 each integral with an opposite edge of the outer wall sheathing contact sheet 36, and a pair of stiffener tab positioning flanges 44,44 each integral with the stiffener tab 38.

In the usual situation, a number of the house roof insulation vents 32 will be stacked together in a flat condition and packaged and/or sold in that condition. One such insulation vent will be required for each passageway to be established between roof rafters throughout the entire building. One such insulating vent 32 in its flat form is illustrated in FIG. 2.

Figure 2:
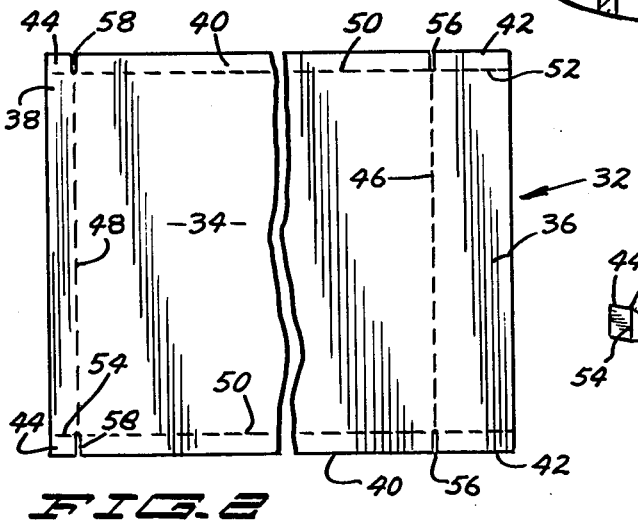
FIG. 2 is an elevational view of a house roof insulation vent of the invention in its preformed flattened condition as it will be packaged for sale, for example.

In FIG. 2, a plurality of pre-scored crease lines are indicated by dotted lines. Sheathing contact sheet crease line 46 marks the integral connection between the sheathing contact sheet 36 and the roof clearing sheet 34. Stiffener crease line 48 marks the integral connection between the roof clearing sheet 34 and the stiffener tab 38. Roof spacer flange crease lines 50,50 mark the integral connection between the spacer flanges 40,40 and the roof clearing sheet; while sheathing contact sheet positioning flange creases 52,52 mark the integral connection between the outer wall sheathing contact sheet 36 and its positioning flanges 42,42; and stiffener tab flange creases 54,54 mark the integral connection between the stiffener tab 38 and its positioning flanges 44,44. Sheathing contact sheet flange slits 56,56 and stiffener tab flange slits 58,58 are provided to permit the bending of the sheathing contact sheet 36 and the stiffener tab 38 with respect to the roof clearing sheet 34 in a manner to be described.

Corrugated cardboard of the type customarily used in packing boxes and shipping containers has been found excellent for constructing insulation vents in accordance with the invention; but many other materials such as metalized cardboard or tagboard, stiff tagboard, wood or wood fiberboard provided with bendable connections at the "crease lines", bendable and deformable metal sheets, and the like will also be satisfactory.

Figure 3:
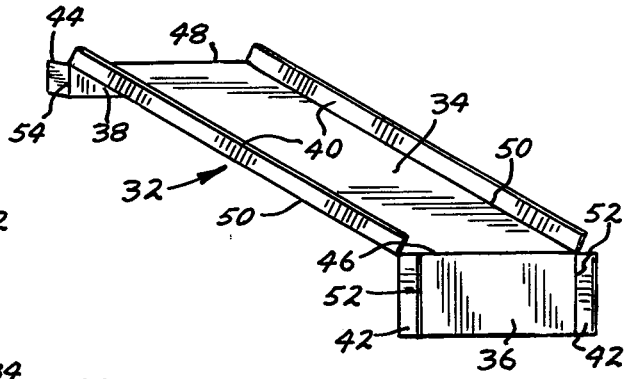
FIG. 3 is a perspective view of the roof vent of FIGS. 1 and 2 showing its configuration as if it were installed in FIG. 1.

To install the house roof insulating vent of the invention in a manner as seen in FIG. 1 during construction of the house, for example, the roof clearing sheet spacer flanges 40,40 will be bent upwards 90° to position as seen in FIG. 3. Without necessarily bending the stiffener tab 38 or the sheathing contact sheet 36, the flanges 42,42 and the flanges 44,44, can also be bent upwardly at the same time. Before any insulating material is installed in the house, rectangular roof clearing sheet 34 and roof clearing sheet spacer flanges 40,40 will be put into position relative to housing structure 10 as seen in FIG. 1. Sheathing contact sheet 36 will be bent down to position it and its positioning flanges 42,42 in position as seen in FIG. 1, and nails 60,60 or staples or other means will be used to permanently fasten these positioning flanges 42,42 against the roof rafters 24,24. Roof clearing sheet upper end stiffener tab 38 and its positioning flanges 44,44 will be bent to position as seen in FIG. 1, and nails 60 or staples or other suitable fastening means will be used to permanently affix these flanges against the roof rafters 24,24.

Insulating material 62, whether in the form of batts or in particulate form, can then be forced or blown or poured into position over wall plate 22, the ceiling wall board 18 and up against the underside of the roof clearing sheet 34 all as seen in FIG. 1. If the sheathing 30 does not come up as high as is illustrated in FIG. 1, the sheathing contact sheet 36 will stop the insulating material 62 from going past the surface of the outside wall.

At this point or even before the insulating material 62 is installed, a soffit 64 including a soffit vent 66 can be added to the house in any usual or preferred manner.

With the construction as seen in FIG. 1 now in place, it is evident that a passageway having a clearance equal to the depth of the roof clearing sheet spacer flanges 40,40 will be maintained over the entire life of the building. Should the insulating material settle and further insulation be added later, the insulation vent 32 will still be in position to maintain the free air passageway between the soffit vent and roof vents (not shown) in the attic above the insulating material.

Figure 4:
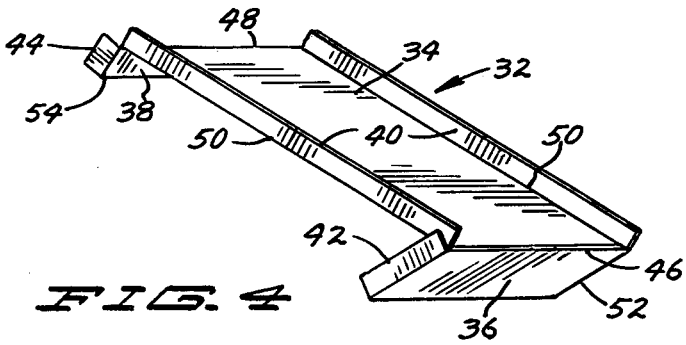
FIG. 4 is a perspective view of the house insulation vent of the first three figures, but positioned as it would be for installation from inside of an attic, as would be appropriate in connection with its installation in existing housing.

In order to install a house roof insulation vent 32 entirely from within a house which is already constructed, or from within a house under construction, the sheathing contact sheet positioning flanges 42,42 will be bent downwardly at the time the roof clearing sheet spacer flanges 40,40 and the stiffener tab positioning flanges 44,44 are bent up. The sheathing contact sheet 36 will be bent into an acute angular relationship back under the roof clearing sheet 34 as illustrated in FIG. 4, and the insulation vent 32 will be moved to position the roof clearing sheet 34 and the roof clearing sheet spacer flanges 40,40 in the position as seen in FIG. 1. The stiffener tab 38 can be bent downwardly and its positioning flanges 44 nailed or stapled into position as seen in FIG. 1. Then the outer wall sheathing contact sheet 36 can be pushed forward until it makes contact with the inside of the outer wall sheathing 30, and the sheathing contact sheet positioning flanges 42,42 can be nailed or stapled or glued into place.

If the length of the sheathing contact sheet 36 away from the roof clearing sheet 34 is going to be so great that the contact sheet will hit the top of the wall plate 22 before it gets to an upright position, the length of that sheathing contact sheet and its positioning flanges 42,42 can be trimmed before the insulation vent 32 is put into place.

Once positioned as described above, the roof house insulation vent installed from the inside will work in exactly the same manner as the same vent installed as seen in FIG. 1.

The embodiments of the invention in which an exclusive property or privilege is claimed are defined as follows:

1. A house roof insulation vent for use in a house having an enclosed room partially defined by an outer wall including vertical outer wall sheathing and a horizontal upper outer wall plate, spaced apart, parallel attic floor joists supported above said outer wall plate, and a room ceiling layer depending from said joists; said house also having spaced apart inclined roof rafters supported above said outer wall plate and extending beyond said outer sheathing, roof boards fastened on upper edges of said rafters, and insulating material covering said ceiling layer to a substantial depth; said insulation vent providing an air passage free of insulating material along and spaced from said roof boards from outside of said sheathing to well above the depth of insulating material; and said insulation vent including:

A. a rectangular roof clearing sheet extending between adjacent roof rafters;

B. roof clearing sheet spacer flanges extending integrally upwardly from said roof clearing sheet into contact with the underside of said roof boards to maintain said roof clearing sheet at a predetermined spaced relationship with respect to said roof boards;

C. a roof clearing sheet stiffener tab integral with an upper end of said roof clearing sheet and extending away from it and away from said roof boards in normal relationship to said roof clearing sheet;

D. stiffener tab positioning flanges integral with side edges of said stiffener tab and extending outwardly therefrom along the surfaces of adjacent roof rafters;

E. means fastening said stiffener tab positioning flanges to said rafters to maintain said tab in fixed relation to said roof clearing sheet; and F. means at a lower portion of said roof clearing sheet for sealing said roof clearing sheet to said outer wall sheathing to prevent passage of insulating material between said roof clearing sheet and outer house wall, said means including:

(1) an outer wall sheathing contact sheet integral with a lower end of said roof clearing sheet and extending away from it and away from said roof boards, (2) sheathing contact sheet positioning flanges integral with side edges of said sheathing contact sheet and extending outwardly therefrom along the surfaces of adjacent roof rafters, and (3) means fastening said sheathing contact sheet positioning flanges to said roof rafters to fixedly position said sheathing contact sheet in sealing relationship with respect to said wall sheathing.

2. The insulation vent of claim 1 wherein said sheathing contact sheet positioning flanges extend toward the interior of the house so that they can be fastened to the rafters from inside of the house.

3. The insulation vent of claim 1 wherein said sheathing contact sheet positioning flanges extend away from the interior of the house so that they can be fastened to the rafters from ouside of the house.

4. A flat board of material deformable along pre-scored lines to form the house roof insulation vent of claim 1, said board including:

A. A rectangular roof clearing sheet;

B. A rectangular outer wall sheathing contact sheet integral with and extending away from said roof clearing sheet along an entire first end of said roof clearing sheet;

C. A pre-scored sheathing contact sheet crease line at the point of integral connection between said roof clearing sheet and said outer wall sheathing contact sheet;

D. Sheathing contact sheet positioning flanges extending away from opposed outer end edges of said outer wall sheathing contact sheet;

E. A pair of pre-scored sheathing contact sheet positioning flange creases at the point of integral connection between said sheathing contact sheet and said sheathing contact sheet positioning flanges;

F. A clearing sheet stiffener tab integral with and extending outwardly from an entire second end of said roof clearing sheet;

G. A pair of stiffener tab positioning flanges extending outwardly from opposite end edges of said clearing sheet upper end stiffener tab;

H. A pair of pre-scored stiffener tab flange creases at the integral connection of said clearing sheet stiffener tab and its stiffener tab positioning flanges; and I. There being a slit between adjacent ends of the roof clearing sheet spacer flanges and the stiffener tab positioning flanges and between the roof clearing sheet spacer flanges and the sheathing contact sheet positioning flanges.

* * * * *